United States Patent [19]

Murphy

[11] Patent Number: 4,540,008

[45] Date of Patent: Sep. 10, 1985

[54] COIN CARRIER WITH PLURAL SLIDABLE POCKETS

[76] Inventor: Kent D. Murphy, 4401 East-West Hwy., Bethesda, Md. 20014

[21] Appl. No.: 513,006

[22] Filed: Jul. 12, 1983

[51] Int. Cl.[3] ..... G07D 9/00

[52] U.S. Cl. ..... 133/5 A; 221/92

[58] Field of Search ..... 206/0.80, 0.81, 0.83, 206/0.84; 133/5 A, 5 B, 5 R, 6; 221/92

[56] References Cited

U.S. PATENT DOCUMENTS

| | | | |
|---|---|---|---|
| 544,330 | 8/1895 | Walker | 133/5 R |
| 1,420,377 | 6/1922 | Hopkins | 133/5 A |
| 2,245,066 | 6/1941 | Bouchard | 133/5 A |
| 2,766,762 | 10/1956 | Gordon | 133/5 B |
| 3,359,993 | 12/1967 | Tryon et al. | 221/287 X |
| 4,413,750 | 11/1983 | Morrone et al. | 133/5 A |

FOREIGN PATENT DOCUMENTS

| | | | |
|---|---|---|---|
| 542559 | 4/1956 | Italy | 133/5 A |

*Primary Examiner*—Stanley H. Tolberg
*Attorney, Agent, or Firm*—Brady, O'Boyle & Gates

[57] ABSTRACT

Coins in commonly used denominations are held in cavities of a slide which can be moved in a linear path between two walls of a slide housing by a slide operator which is accessible from the exterior of the slide housing. The slide is resiliently biased to a coin non-removable position and is easily extendable by thumb action to a coin delivery position where all coin denominations are simultaneously accessible and can be removed in a canting or tilting mode.

13 Claims, 10 Drawing Figures

COIN CARRIER WITH PLURAL SLIDABLE POCKETS

BACKGROUND OF THE INVENTION

The present invention seeks to provide a pocket-size coin carrier or holder which is more convenient and practical in its operation than known coin carriers in the prior art. More particularly, it is an object of the invention to provide a coin carrier in which coins of the most common denominations are contained in rigid arcuate cavities on a slide which can be moved on a linear path between two housing walls to simultaneously shift all of the coins to an easy removal position, the slide being resiliently biased to a retracted position between the housing walls where removal of all coins in the carrier is prevented.

Another object of the invention is to provide a coin carrier of the mentioned type having a slide operator which can be engaged and shifted by the thumb of one hand holding the device.

Another object is to provide a coin carrier adapted to be manufactured from molded plastics, and which can be constructed to hold domestic or foreign coins with equal facility.

Other features and advantages of the invention will become apparent during the course of the following detailed description.

DETAILED DESCRIPTION

Figure 1:
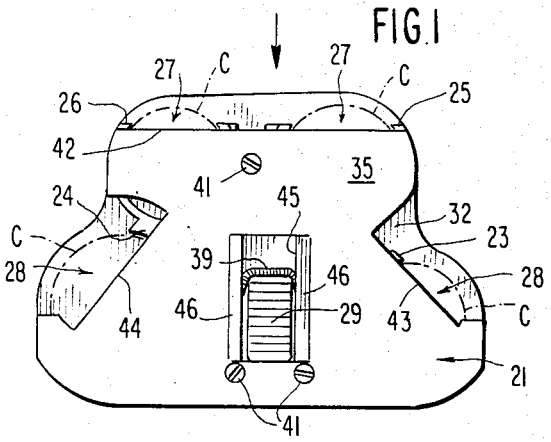
FIG. 1 is a plan view of a coin carrier according to the present invention showing the coin slide and coins in a fully retracted non-delivery position.
Figure 2:
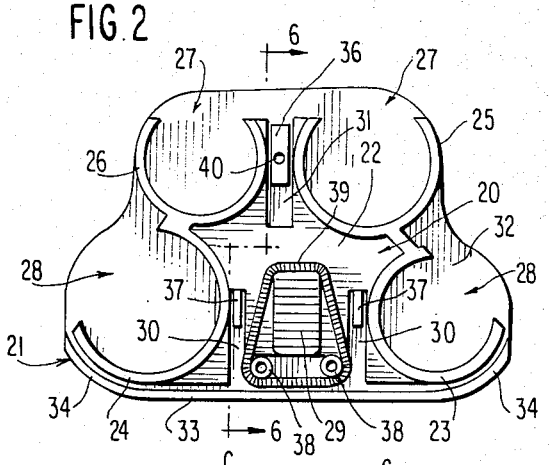
FIG. 2 is a view similar to FIG. 1 with the top wall of the slide housing removed.
Figure 5:
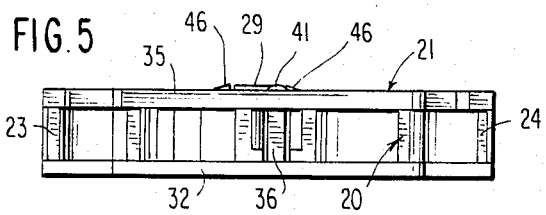
FIG. 5 is an edge elevation of the coin carrier viewed in the direction of the arrow in FIG. 1.
Figure 3:
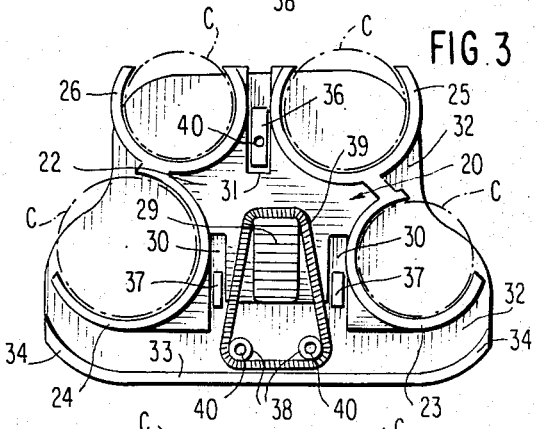
FIG. 3 is a view similar to FIG. 2 showing the coin slide extended to the coin delivery position.

Referring to the drawings in detail wherein like numerals designate like parts, and referring initially to FIGS. 1 through 7, a coin carrier according to the invention comprises a coin slide 20 adapted to move on a linear path between two spaced parallel walls of a slide housing 21.

Figure 4:
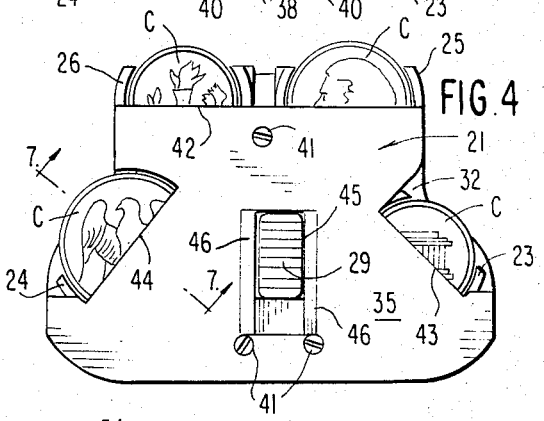
FIG. 4 is a view similar to FIG. 1 showing the coin slide and coins in the delivery position corresponding to FIG. 3.

The coin slide 20 is of unitary construction, consisting of a flat wall 22 on which is integrally formed preferably four rising part circle walls 23, 24, 25 and 26 of different diameters and arranged in spaced pairs. The walls 23 and 24 at the rear of coin slide 20 are spaced a greater distance laterally than are the walls 25 and 26 at the forward end of the slide 20. The part circle walls 23, 24, 25 and 26 are of different diameters to receive coins of different denominations, such as pennies, quarters, nickels and dimes, respectively, as shown in FIG. 4.

In this connection, the coin carrier is not limited to the handling of these particular domestic coins and can be constructed to accept other domestic and foreign coins of various denominations merely by changing the diameters of the walls 23, 24, 25 and 26.

The walls 23 . . . 26 are constructed to extend around considerably more than one-half the circumference of the coins being held and preferably extend circumferentially about 240°, providing relatively wide mouths for the coin pockets thus formed. The mouths 27 formed by the walls 25 and 26 are forwardly open on the coin slide 20 while the mouths 28 of walls 23 and 24 are divergent and open on axes at about 45° to the longitudinal axis of the slide 20.

The coin slide 20 includes an upstanding approximately rectangular cross section thumb operator 29 rising from its rear end substantially midway between the centers of the two part circle walls 23 and 24. On opposite sides of the thumb operator 29, the coin slide has two parallel longitudinal guide slots 30 opening through the rear edge of flat wall 22 and having forward ends terminating near and somewhat forwardly of the centers of the walls 23 and 24. The coin slide has a third longitudinal guide slot 31 opening through its forward edge and being centered between the two walls 25 and 26 and having an interior ends terminating near the center of the slide 20.

The coin slide housing 21 comprises a bottom wall 32 constituting a flat floor for the four coin pockets formed by the part circle walls 23 . . . 26, the coin slide having its bottom surface directly slidable on the wall 32. A rear housing wall 33 having curved end portions 34 rises from the rear edge of bottom wall 32.

The coin slide housing 21 further includes a top wall 35 spaced from and parallel to the bottom wall 32. The housing is essentially open along its two sides and forward end. A rectangular cross section guide post 36 rises from the housing bottom wall 32 near the front of the housing and projects guidingly through the slot 31. Similarly, two shallow guide lugs 37 rise from the housing bottom wall 32 rearwardly of the post 36 and are received guidingly in the two slots 30 of the coin slide 20.

Figure 6:
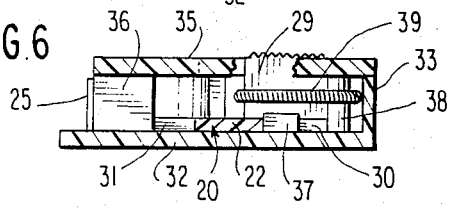
FIG. 6 is a vertical section taken on line 6—6 of FIG. 2.

Two laterally spaced posts 38 also rise from the housing bottom wall 32 and are fixed thereto near its rear edge and are located between the part circle walls 23 and 24 and somewhat rearwardly thereof. A garter spring 39 surrounds the two posts 38 and the forward side of coin slide operator 29 and serves to bias the coin slide in a fully retracted position shown in FIG. 2 where the guide lugs 37 are in contact with the forward terminals of guide slots 30. The tops of posts 38 and 36 are in a common plane and support the flat housing top wall 35 which rests upon the three posts as best shown in FIG. 6. The posts 36 and 38 have threaded apertures 40 therein which receive screws 41 placed through openings in the top plate 35 of the housing, these screws serving to secure the top and bottom walls of the housing 21 assembled with the slide 20 disposed movably therebetween.

The two posts 38 thus perform two functions in the coin carrier and the guide post 36 performs two functions.

Figure 7:
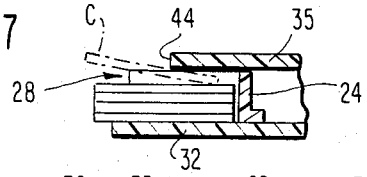
FIG. 7 is a fragmentary vertical section taken on line 7—7 of FIG. 4.

The housing top wall 35 has a transverse frontal edge 42 which terminates slightly rearwardly of the mouths of part circle walls 25 and 26 when the coin slide 20 is fully retracted. The top wall 35 has a pair of opposite side cut-outs or notches 43 and 44 whose straight edges converge forwardly as shown in the drawings. When the coin slide is fully extended, FIGS. 3 and 4, the converging edges of cut-outs 43 and 44 lie substantially on the diameters of circles defined by the part circle walls 23 and 24, and similarly the forward edge 42 lies substantially on or across the diameters of the two circles defined by walls 25 and 26. When the coin slide 20 is retracted, FIGS. 1 and 2, the converging edges 43 and 44 and the frontal straight edge 42 no longer lie on diameters of the four circles encompassed by the walls 23 . . . 26 but instead these edges span smaller sectors of the four circles and lie substantially at the restricted mouths 27 and 28 of the coin pockets or compartments. The walls 23 . . . 26 are rigid and extend for substantially the entire distance between housing walls 32 and 35. Therefore, when the coin slide 20 is fully retracted, it is impossible to remove any coin from the carrier because the full diameter of no coin of any denomination is able to pass between the housing top wall 35 and the top of the particular coin pocket defined by one of the part circle walls. However, when the coin slide 20 is extended to the position shown in FIGS. 3 and 4 by use of the thumb operator 29 and by stretching of the spring 39, coins are readily removable from any and all of the coin pockets through spaces then defined by the edges 43, 44 and 42 of housing top wall 35 and the respective part circle walls 23 . . . 26. To effect coin removal through these spaces or passageways, FIG. 7, the topmost coin C of each stack of coins is canted or tilted toward the housing wall 35 as shown in FIG. 7 and is then readily removable, but only removable while the coin slide 20 is in the extended or advanced position. The mode of operation is simple and positive and very convenient.

Following removal of desired coins for any purpose, the slide 20 retracts automatically by the tension of spring 39 to the position where coins cannot leave the coin carrier, merely by releasing the slide operator 29.

It is to be noted that there is no dependency on resiliency of coin pockets or their walls in effecting the release of coins from the carrier. The coins are rendered releasable only after coacting rigid components are placed in relative positions through a simple linear movement in one direction of the coin slide 20 to sufficiently enlarge a passageway between each part circle wall and the overlying relatively stationary housing wall 35. In contrast to certain prior art devices, coins of several denominations are all positioned simultaneously for easy removal according to the present invention, and the invention avoids the use of elements which must be moved on an arcuate path to effect coin discharge, as it is felt that a simple linear movement is more convenient.

It should be noted that the coin slide thumb operator 29 extends through a longitudinal slot 45 provided in the housing top wall 35. Preferably, this slot is bounded on opposite sides by two shallow parallel longitudinal inclined ramps 46 whose tops are flush with the serrated top face of the operator 29, FIG. 5. This arrangement lessens the likelihood of the operator 29 being accidentally displaced.

Figure 8:
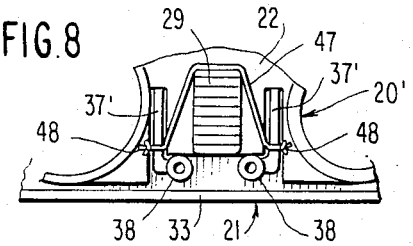
FIG. 8 is a fragmentary plan view similar to FIG. 2 showing a modification.

FIG. 8 depicts a modification of the invention where, instead of the garter spring 39, an elastic element 47 is employed to bias the coin slide 20' to its retracted position relative to the slide housing 21. The guide lugs 37' are extended somewhat rearwardly and are integrally connected with the two posts 38. The elastic element 37 may have its ends knotted at 48 on the outer sides of the lugs 37', the elastic element extending through apertures provided in the lugs 37'. The elastic element extends around the forward end of the slide operator 29, as shown in FIG. 8. All other parts of the coin carrier and its mode of operation are identical to the previously-described embodiment.

Figure 9:
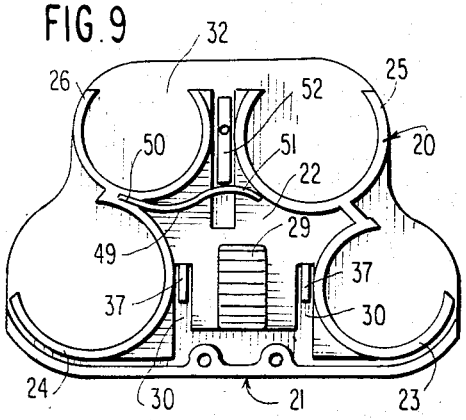
FIG. 9 is another plan view similar to FIG. 2 showing a further modification.

FIG. 9 shows another modification of the invention in which the coin slide 20 is biased normally to its retracted position relative to the housing 21 by a leaf spring 49 having one end portion 50 anchored in a slot of the slide 20 and having a forward end portion 51 bearing upon a forward guide post 52 rising from the lower wall 32 of housing 21. All other parts and their functions remain as previously described.

Figure 10:
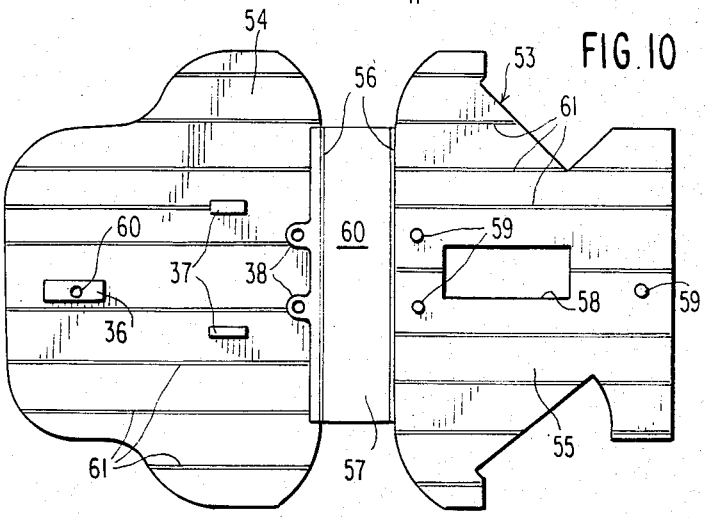
FIG. 10 is a plan view of an integral hinged coin slide housing according to still another modification and being shown in an unfolded flat position.

FIG. 10 shows another modification of the invention in which a coin slide housing 53 of unified construction comprises a housing bottom wall 54 and top wall 55 are joined through living hinges 56 with a housing rear wall 57. The previously-described posts 36 and 38 are formed on and rise from the housing bottom wall 54 together with guide lugs 37. A slot 58 to receive the slide operator 29 is formed through the top wall 55. The top and bottom walls 55 and 54 are contoured in the same manner as the separately formed walls 35 and 32 of the initial embodiment.

In lieu of the assembly screws 41 of the initial embodiment, snap lugs 59 are formed on the lower face of the hinged housing top wall 55 to engage in snap sockets 60 formed in the tops of posts 36 and 38. Preferably, multiple parallel shallow raised ribs 61 are provided on the opposing faces of the two plates 54 and 55 to reduce friction between these housing plates and the coin slide 20. The slide 20 in its construction and operation remains essentially as shown and described in the previous embodiments of the invention.

The terms and expressions which have been employed herein are used as terms of description and not of limitation, and there is no intention, in the use of such terms and expressions, of excluding any equivalents of the features shown and described or portions thereof but it is recognized that various modifications are possible within the scope of the invention claimed.

I claim:

1. A coin carrier comprising a pocketed coin slide adapted to contain stacks of coins, a housing receiving the coin slide and being guidingly engaged therewith so that the coin slide can be moved on a linear path relative to the housing, the housing including top and bottom walls forming at least partial closures for the tops and bottoms of the pockets of said coin slide, resilient means connected between the coin slide and housing and biasing the coin slide to a retracted position on the housing, a manual operator on the coin slide accessible from the exterior of the housing by means of which the coin slide and the pockets thereof and all of the stacks of coins in the pockets can be moved on said linear path to an extended coin removal position relative to the housing, and the pockets of the coin slide and the housing having cooperative passage means enabling selective removal of coins from the tops of said pockets when the coin slide is in the extended position and blocking the removal of coins when the coin slide is in the biased retracted position.

2. A coin carrier as defined in claim 1, and said cooperative passage means comprising side wall openings in the pockets of the coin slide, and cooperative straight edge portions on one wall of said housing substantially adjacent to the side wall openings when the coin slide is in the retracted position.

3. A coin carrier comprising a pocketed coin slide adapted to contain stacks of coins of different denominations, a housing receiving the coin slide and being guidingly engaged therewith so that the coin slide can be moved on a linear path relative to the housing, the housing including top and bottom walls forming at least partial closures for the tops and bottoms of the pockets of said coin slide, resilient means connected between the coin slide and housing and biasing the coin slide to a retracted position on the housing, a manual operator on the coin slide accessible from the exterior of the housing by means of which the coin slide can be moved on said linear path to an extended coin removal position relative to the housing, the pockets of the coin slide and the housing having cooperative passage means enabling removal of coins from said pockets when the coin slide is in the extended position and blocking the removal of coins when the coin slide is in the biased retracted position, said cooperative passage means comprising side wall openings in the pockets of the coin slide, and cooperative straight edge portions on one wall of said housing substantially adjacent to the side wall openings when the coin slide is in the retracted position, and the coin pockets of said slide being defined by a plurality of separated part circle side walls of different diameters each having a side wall opening of substantially lesser width than the diameter of the coins accepted by such pockets, and said cooperative straight edge portions extending substantially across the side wall openings in substantial registration therewith when the coin slide is in its retracted position.

4. A coin carrier as defined in claim 3, and a forward pair of said coin pockets having their respective side wall openings facing in a common forward direction in a common plane across the coin slide, and a rear pair of the coin pockets having their side wall openings in divergent relationship toward opposite sides of the coin carrier, and said cooperative straight edge portions comprising a single transverse straight edge across the side wall openings of the forward pair of coin pockets and a pair of angled straight edges across the divergent side wall openings of the rear pair of coin pockets.

5. A coin carrier as defined in claim 1, and said manual operator comprising a post operator on the coin slide engaging through a slot formed in one wall of said housing, and the resilient means comprising a garter spring looped about the post operator and fixed elements of said housing.

6. A coin carrier as defined in claim 5, and said housing comprising a pair of parallel flat top and bottom walls and a rear end wall carried by one of said top and bottom walls, guide elements for the coin slide carried by one of said top and bottom walls of the housing, and cooperative parallel guide slots formed in the coin slide and guidingly receiving said guide elements.

7. A coin carrier as defined in claim 1, and said resilient means comprising an elastic element engaging a part of the coin slide to be stretched thereby when the coin slide is shifted to the extended position and having opposite ends attached to elements on said housing.

8. A coin carrier as defined in claim 1, and said resilient means comprising a leaf spring having one end portion anchored to the coin slide and extending across a relatively stationary part on said housing and engaging said part under tension to thereby bias the coin slide toward the retracted position.

9. A coin carrier as defined in claim 6, and said housing being of one piece construction wherein said top and bottom walls and rear end wall are integrally joined by parallel living hinges.

10. A coin carrier as defined in claim 9, and snap lugs carried by one of said top and bottom walls and being engageable in snap sockets carried by the other of the top and bottom walls whereby the top and bottom walls are adapted to be connected in parallel spaced relationship.

11. A coin carrier comprising a coin slide having plural separated substantially rigid part circle coin pockets of different diameters and of a depth for stacks of coins of different denominations, said part circle coin pockets being open ended, a housing for the coin slide having at least spaced parallel walls adjacent the open ends of said pockets, interengaged linear guide means on the coin slide and housing, resilient means connected between the coin slide and housing and biasing the coin slide in one linear direction on the housing, said part circle coin pockets having side wall openings facing outwardly of said housing, and cooperative straight edge portions on one of said housing walls adapted to register substantially with side wall openings of the part circle coin pockets when the coin slide is in its biased position, and said side wall openings of the part circle pockets moving to non-registering positions relative to said straight edge portions when the coin slide and the stacks of coins carried thereby is moved on a linear path against the biasing force of said resilient means, whereby coins from the tops of the stacks of coins are then rendered removable from the tops of the coin pockets through passages which are then formed between said straight edge portions and part circle coin pockets, said passages being wider than the diameters of the coins being removed.

12. A coin carrier as defined in claim 11, and said passages through which coins are removable being defined between said straight edge portions and the side wall openings of the part circle coin pockets.

13. A coin carrier comprising a body portion, a coin slide having plural coin pockets for stacks of plural coins, the coin slide being guidably engaged with the body portion and being shiftable on a linear path to a retracted coin retaining position and to an extended coin delivery position, all of the coin pockets of said slide and all of the stacks of coins therein being positioned to enable coins to be selectively removed from the tops of the stacks by tilting operation through the tops of the coin pockets when said slide is in said delivery position, and means resiliently biasing the coin slide to said coin retaining position.

* * * * *